US009175406B2

(12) United States Patent
Wang et al.

(10) Patent No.: US 9,175,406 B2
(45) Date of Patent: Nov. 3, 2015

(54) METHOD OF SURFACE TREATMENT FOR METAL GLASS PART, AND METAL GLASS PART WITH ITS SURFACE TREATED BY THE METHOD

(75) Inventors: Xin Min Wang, Miyagi (JP); Naokuni Muramatsu, Aichi (JP); Junsuke Kiuchi, Fukui (JP); Hiroshi Suzuki, Fukui (JP); Tatsue Arakawa, Miyagi (JP); Hisamichi Kimura, Miyagi (JP); Akihisa Inoue, Miyagi (JP); Eiichi Makabe, Miyagi (JP)

(73) Assignees: TOKOKU UNIVERSITY, Miyagi (JP); NGK INSULATORS, LTD., Aichi (JP)

( * ) Notice: Subject to any disclaimer, the term of this patent is extended or adjusted under 35 U.S.C. 154(b) by 1481 days.

(21) Appl. No.: 12/530,920

(22) PCT Filed: Mar. 13, 2007

(86) PCT No.: PCT/JP2007/054896

§ 371 (c)(1),
(2), (4) Date: Sep. 11, 2009

(87) PCT Pub. No.: WO2008/111163

PCT Pub. Date: Sep. 18, 2008

(65) Prior Publication Data

US 2010/0089761 A1 Apr. 15, 2010

(51) Int. Cl.
*C25D 5/34* (2006.01)
*C23C 28/00* (2006.01)
(Continued)

(52) U.S. Cl.
CPC ..... *C23G 1/02* (2013.01); *C23C 18/165* (2013.01); *C23C 18/1844* (2013.01);
(Continued)

(58) Field of Classification Search
CPC ..... C25D 5/34; C23C 28/00
USPC ..... 205/162; 427/299, 307, 309, 402, 407.2
See application file for complete search history.

(56) References Cited

U.S. PATENT DOCUMENTS 3,686,020 A * 8/1972 Coll-Palagos ..... 427/305
4,128,459 A * 12/1978 Bretts et al. ..... 205/138
(Continued)

FOREIGN PATENT DOCUMENTS

CN 1311828 9/2001
EP 0 190 465 A2 4/1994
(Continued)

OTHER PUBLICATIONS

Namkung, et al "The filtering medium properties of electro-less plated metallic glass", Materials Science and Engineering A 375-377 (2004) pp. 1121-1124.*
(Continued)

*Primary Examiner* — Edna Wong
(74) *Attorney, Agent, or Firm* — Lucas & Mercanti, LLP

(57) ABSTRACT

There is provided a metallic glass component with its surface layer having both durability of a film and chromatic color properties, and a method for forming the surface layer. Surface active treatment is performed wherein the surface of the metallic glass component is reacted with a mixed aqueous solution of nitric acid and hydrofluoric acid to remove an oxide film and to provide an anchor bond shape on the surface of a metallic glass component, and electroplating or electroless plating is then performed, to form a plating film on the surface of the metallic glass component. It is thereby possible to form a surface layer of a metallic glass which has both durability and a chromatic color.

6 Claims, 5 Drawing Sheets

(51) Int. Cl.

| | |
|---|---|
| ***C25D 5/54*** | (2006.01) |
| ***C23G 1/02*** | (2006.01) |
| ***C23C 18/16*** | (2006.01) |
| ***C23C 18/18*** | (2006.01) |
| ***C23C 18/31*** | (2006.01) |
| ***C23G 1/08*** | (2006.01) |
| ***C23G 1/10*** | (2006.01) |
| ***C25D 5/36*** | (2006.01) |
| ***C25D 5/38*** | (2006.01) |
| ***C25D 5/40*** | (2006.01) |
| ***C25D 5/48*** | (2006.01) |

(52) U.S. Cl.

CPC ..... *C23C 18/31* (2013.01); *C23G 1/086* (2013.01); *C23G 1/10* (2013.01); *C23G 1/103* (2013.01); *C23G 1/106* (2013.01); *C25D 5/34* (2013.01); *C25D 5/36* (2013.01); *C25D 5/38* (2013.01); *C25D 5/40* (2013.01); *C25D 5/48* (2013.01); *C25D 5/54* (2013.01)

(56) References Cited

U.S. PATENT DOCUMENTS

| | | | | |
|---|---|---|---|---|
| 4,939,041 | A * | 7/1990 | Kabacoff et al. | 428/607 |
| 5,417,803 | A * | 5/1995 | Goldstein et al. | 216/2 |
| 5,558,759 | A * | 9/1996 | Pudem | 205/50 |
| 2005/0016959 | A1 * | 1/2005 | Tan et al. | 216/83 |
| 2008/0001243 | A1 * | 1/2008 | Otake et al. | 257/437 |

FOREIGN PATENT DOCUMENTS

| | | | | |
|---|---|---|---|---|
| JP | 52-885511 | | 7/1977 | |
| JP | 02-018996 | A | 1/1990 | |
| JP | 06-091807 | A | 4/1994 | |
| JP | 06-306675 | A | 11/1994 | |
| JP | 07-207425 | A | 8/1995 | |
| JP | 08-144083 | A | 6/1996 | |
| JP | 10212134 | A * | 8/1998 | C03C 4/00 |
| JP | 2002-020889 | A | 1/2002 | |
| JP | 2003-166044 | | 6/2003 | |
| JP | 2005-509090 | | 4/2005 | |
| JP | 2007-77475 | | 3/2007 | |
| KR | 20010025601 | A | 4/2001 | |
| WO | 00/08233 | | 2/2000 | |
| WO | WO 2006077719 | A1 * | 7/2006 | H01L 31/04 |

OTHER PUBLICATIONS

Kim et al., "Electroless Nickel-Phosphorus Plating on Ni—Zr—Ti—Si—Sn Amorphous Powder", Surface & Coatings Technology (no month, 2005), vol. 195, pp. 176-181.*

Li et al., "Nanocrystalline Coating Enhanced Ductility in a Zr-Based Bulk Metallic Glass", J. Mater. Res. (Feb. 2007), vol. 22, No. 2, pp. 508-513.*

Li et al., "Nanocrystalline Coating Enhanced Ductility in a Zr-Based Bulk Metallic Glass", J. Mater. Res. (Feb 2007), vol. 22, No. 2, pp. 508-513.*

Copy of Communication (Extended European Search) dated Dec. 7, 2012 issued by the European Patent Office in European Patent Application No. 07738368.5 (4 pages).

Copy of Communication (Office Action) dated Jun. 19, 2013 issued by the Korean Patent Office in Korean Patent Application No. 10-2009-7012948 (Korean Language) (6 pages).

Copy of Communication (Office Action) dated Sep. 28, 2009 issued by the Japanese Patent Office in Japanese Patent Application No. 2008-268884 (Japanese Language) (3 pages).

* cited by examiner

METHOD OF SURFACE TREATMENT FOR METAL GLASS PART, AND METAL GLASS PART WITH ITS SURFACE TREATED BY THE METHOD

CROSS REFERENCES AND INCORPORATION BY REFERENCE

This is a U.S. National Phase Application under 35 U.S.C. 371 of International Application PCT/JP2007/054896, filed on Mar. 13, 2007, which is incorporated herein by reference.

BACKGROUND OF THE INVENTION

1. Field of the Invention

The present invention relates to a metallic glass component with its surface layer having both chromatic color properties and durability of a film such as corrosion resistance, weathering resistance, fingerprint wiping properties, and peeling resistance, and a method for forming the surface layer.

2. Description of the Related Art

Metal glass has a composition in which an amorphous metal is formed even at a cooling temperature of not higher than 100 K/second, and there is known a method for forming a large-shaped amorphous metal (bulk metallic glass) directly from a molten metal by using already developed water hardening, arc melting, mold casting, high-pressure projection molding, suction casting, or some other methods. Metal glass has a unique mechanical characteristic of being free from a defect as having high strength, a low Young's modulus, high corrosion resistance, and a grain boundary, which is an essential property of an amorphous metal and is not of a crystalline metal. Furthermore, it has been possible to obtain a large-sized amorphous bulk body by the above-mentioned methods, and it has been widely expected to put the bulk body into practical use.

The surface of such metallic glass is treated so as to have an added value as a component in addition to its essential, excellent mechanical characteristics and physical properties. For example, (1) anodization (e.g. Patent Document 1) and (2) atmosphere heating oxidation (e.g. Patent Document 2) have been attempted as conventional surface treatment, and the surface has been colored by such treatment.

Patent Document 1: National Publication of International Patent Application No. 2005-509090 "Improved metal frame for electronic device and flat panel display", Liquid metal Technologies Patent Document 2: Japanese Patent Laid-Open No. 2003-166044 "Method for toning zirconium-base amorphous metal", YKK Corporation However, (1) although anodization enables vivid coloring depending upon conditions, since it is treated with an electrochemical function, coloring has often been nonuniformly finished in the case of three-dimensionally treating a large area of the surface of a metallic glass component. Further, for the same reason, a tone of color has sometimes been changed over time despite the passivated surface.

Moreover, (2) atmosphere heating oxidation not only leads to coloring with limited chromatic colors, but also, coloring has often been nonuniformly finished in the case of three-dimensionally treating a large area of the surface of a metallic glass component. Further, there has been a drawback in that, on an oxide film formed by atmosphere heating, natural oxidation proceeds over time to bring about a change in tone of color.

Furthermore, there has also been problems in that, on a nonuniform film formed by above (1) anodization or (2) atmosphere heating oxidation, a corrosion product tends to be generated from salt or mineral floating in the air, a mineral element contained in sweat or a fingerprint when the film is touched with a hand, or the like, to bring about deterioration in appearance and durability.

SUMMARY OF THE INVENTION

As a result of conducting extensive studies with the aim of forming a uniform film having durability and chromatic color properties that are uniform over a large area in order to solve the above-mentioned problems, the present inventors found that covering the surface of a metallic glass component with an electroplated or electroless-plated metal film enables formation of a surface layer having corrosion resistance, weathering resistance and fingerprint wiping properties, having abundant chromatic colors, and being resistant to peeling.

Further, it was also found that covering the surface of the metallic glass component with a metal deposition film formed with a dry plating method such as vacuum deposition, ion plating or sputtering enables formation of a surface layer similar to that formed by plating.

Additionally, it was found that applying and forming a transparent resin coat onto a film formed by plating or the dry plating method enables improvement in durability without impairing a chromatic color of the film itself.

Moreover, it was found that as another method, a gloss chromatic color properties can be added to the surface of the metallic glass component by means of polishing by a physical method, and further that durability against a change over time can be provided by applying and forming a transparent resin coat onto the surface.

In accordance with a first aspect of the present invention, a surface treatment method (FIG. 1) for a metallic glass component 10 comprises: removing an oxide film 12 on a surface of the metallic glass component 10 and providing an anchor bond shape 14 on the surface of the metallic glass component 10 by surface active treatment with a mixed aqueous solution of nitric acid and hydrofluoric acid 18; and forming a plating film 16 on the surface of the metallic glass component 10 by electroplating of electroless plating.

In accordance with a second aspect of the present invention, a surface treatment method (FIG. 2) for a metallic glass component 10 comprises: removing an oxide film 12 on a surface of the metallic glass component 10 and providing an anchor bond shape 14 on the surface of the metallic glass component 10 by surface active treatment with a mixed aqueous solution of nitric acid and hydrofluoric acid 18; and forming a metal deposition film 20 uniformly on the surface of the metallic glass component 10 by a dry plating method such as vacuum deposition, ion plating or sputtering.

The surface treatment method (FIG. 3) may be added a step: adjusting a surface roughness by physical polishing between the surface active treatment and the electroplating or the electroless plating.

The surface treatment method may be added a step: forming a transparent resin coat by applying transparent resin after the electroplating or the electroless plating.

In accordance with a third aspect of the present invention, a surface treatment method for a metallic glass component 10 comprises: removing an oxide film 12 on a surface of the metallic glass component 10 and providing an anchor bond shape 14 on the surface of the metallic glass component 10 by surface active treatment with a mixed aqueous solution of nitric acid and hydrofluoric acid; adding a metal gloss color to the surface of the metallic glass component by physical polishing; forming a resin coat 24 to the surface of the metallic glass component by applying resin. In this case, the resin coat 24 may be colorless transparent, or may be colored transparent.

The resin coat 24 may have a thickness of not smaller than 1 μm and not larger than 10 μm.

A volumetric ratio of nitric acid to hydrofluoric acid may be in the range of one to five, and the mixed aqueous solution of nitric acid and hydrofluoric acid 18 may have a concentration of 1 to 10% in a volumetric ratio.

The metallic glass component 10 may be metallic glass of Zr group, Ti group, Cu group, Ni group, or Fe group.

In accordance with a forth aspect of the present invention, a metallic glass component 10 is treated its surface by the surface treatment method.

A functional mechanism in the above-mentioned surface treatment depends upon judgment by assumption as being the size that cannot be directly observed. A surface active treatment of previously reacted the metallic glass surface to remove the oxide film 12 on the surface with a mixed aqueous solution of nitric acid and hydrofluoric acid 18 is performed using a metallic glass's unique property that is a semi-stable liquid in a super-cooled state even at constant temperature. Then, minute holes as anchor holes in size of several atoms is provided by prompting gentle disruption of gravity while keeping a degree of freedom among a variety of atoms constituting the metallic glass. It has been found that, in formation of the plating film 16, the metal deposition film 20 and the transparent resin coat 24 which are formed after formation of the minute holes, a surface layer decoration processing layer having high adhesiveness can be secured on the surface of the metallic glass component 10 that is difficult to surface-treat, because the surface subjected to the surface active treatment is an active surface without an oxide film 12 and has excellent corrosion resistance with the assistance of the anchor effect by minute holes.

With reference to pickling treatment performed by a commercial Ti (titanium) dealer, hydrofluoric acid is one kind of strong acids that corrode a stable material, and by combination with nitric acid having strong oxidizing properties, it is expected to efficiently remove even the oxide film 12 that is very stable and cannot be removed by a typical acid.

However, only removal of the oxide film 12 was insufficient for a degree of securing adhesiveness of the chromatic color film and the transparent resin coat 24, and after much trial and error under a variety of conditions, preferred ranges of a mixed ratio, concentration, temperature and time were found and further, the surface active treatment conditions were optimized, to complete the present invention.

As thus described, the surface active treatment for removing the oxide film 12 and providing the anchor bond shape 14 in atomic unit is performed by reacting the surface with the aqueous solution of nitric acid and hydrofluoric acid 18. The plating film 16 and the metal deposition film 20 are formed, physical polishing is performed, and the transparent resin coat 24 is further formed. Then, a metallic glass surface layer having both durability and a chromatic color is made.

Moreover, the metallic glass component 10 with the surface layer having both durability and a chromatic color can be made by making up of the transparent resin coat 24 on the surface of the metallic glass component 10, on which physical polishing is performed.

Figure 1:
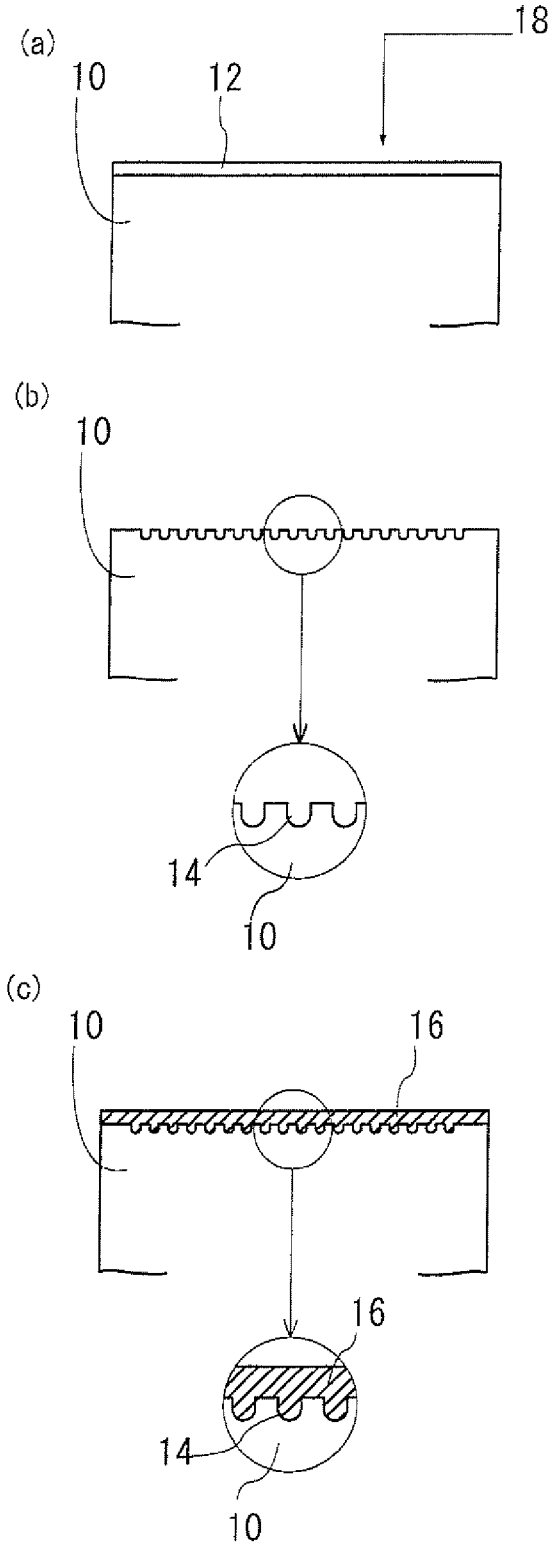
FIG. 1 is a sectional view of surface layers in Embodiments (a) to (c) according to the present invention.

DESCRIPTION OF THE PREFERRED EMBODIMENTS (a), (b), and (c) in FIG. 1 show embodiments of the present invention, respectively showing cross sections of a surface layer (a) before surface active treatment for removing an oxide film 12 formed on the surface of the metallic glass component 10 of Zr group and for providing an anchor bond shape 14 on the surface of a metallic glass component 10, (b) after the treatment, and (c) after subsequent formation of the plating film 16.

It is to be noted that the metallic glass is not restricted to metallic glass of Zr group, but metallic glass of Zr group, Ti, group, Cu group, Ni group, or Fe group containing Zr, Ti, Cu, Ni or Fe as a constituent in the largest amount may be used. The reason these five kinds of metallic glass are considered as preferable for the present invention is that those five kinds of metallic glass have high reactive susceptibility to the mixed aqueous solution of nitric acid and hydrofluoric acid while having excellent durability and mechanical strength among metallic glass, and abundantly exist also as ore resources in the surface layer of the earth, making a raw material relatively cheep, so as to be cost-effective.

The surface active treatment is to remove the oxide film 12 and form an anchor bond shape 14 in an atomic level (namely, fine projections and depressions formed on the surface) on the surface of the metallic glass component 10 by reacting the surface with a mixed aqueous solution of nitric acid and hydrofluoric acid 18, prepared such that a volumetric ratio of nitric acid to hydrofluoric acid is in the range of two to five and the concentration of the mixed aqueous solution of nitric acid and hydrofluoric acid is 1 to 10% in a volumetric ratio. The mixed aqueous solution of nitric acid and hydrofluoric acid 18 is used for strengthening the oxidation properties of hydrofluoric acid as a strong acid to efficiently remove the oxide film 12 so as activate the surface and form the anchor bond shape. Further, the surface active treatment is preferably performed with an aqueous solution at a temperature in the range of not lower than 10° C. and not higher than 40° C. in the reaction time in the range of five minutes to 24 hours.

Further, the reason the volumetric ratio of nitric acid to hydrofluoric acid is restricted to two to five is that the effect of activation is not significantly observed in a volumetric ratio below two, and the effect does not increase even by excessive addition of nitric acid in the volumetric ratio not smaller than five. The volumetric ratio may be appropriately selected in the preferred range of two to five in accordance with the composition of the metallic glass component 10.

The reason of the aqueous solution concentration is restricted is that activation does not occur in the case of the concentration being lower than 1% and an excessive reaction occurs and the surface becomes rougher in the case of the concentration exceeding 10%.

The reason of the aqueous solution temperature is restricted is that the reaction rate extremely decreases in the case of the temperature below 10° C., and conversely, the reaction rate increases in the case of the temperature exceeding 40° C.

Although the reaction time depends upon the mixture composition, concentration and temperature of the aqueous solution, sufficient activation is not obtained in the time shorter than five minutes even when the condition of the maximum reaction rate is selected, whereas sufficient activation is obtained in the order of 24 hours even when the condition of the minimum rate is selected with importance placed on uniformity and a significant progress cannot be expected even by the treatment over 24 hours, which is cost-ineffective.

Further, electroplating or electroless plating is used for forming the plating film 16, and trivalent chromium to become a chromatic color, nickel, gold, silver, platinum, copper, palladium and the like are typically selected, but the such use and selection are not restricted. Moreover, a plating bath may previously contain Teflon (registered trademark) or the like. Plating treatment is performed by conventionally performed electroplating or electroless plating.

Figure 2:
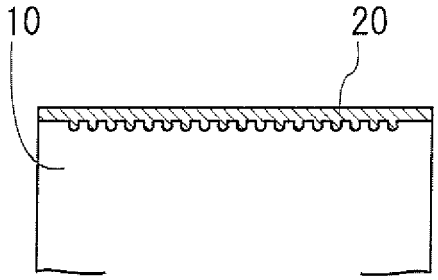
FIG. 2 is a section of the surface layer in the embodiment according to the present invention.

FIG. 2 shows another embodiment of the present invention, in which the metal deposition film 20 was deposited and formed by vacuum deposition on the upper surface of the metallic glass component 10 where the foregoing surface active treatment for removing the oxide film 12 and providing the anchor bond shape 14 had been performed. FIG. 2 shows a sectional view of that surface layer.

Ion plating, sputtering or some other dry plating methods can be used for the method for deposition. As the metal to be deposited, chromium as a chromatic color, nickel, gold, silver, platinum, palladium and the like are typically selected, but the metal to be deposited are not restricted thereto.

Figure 3:
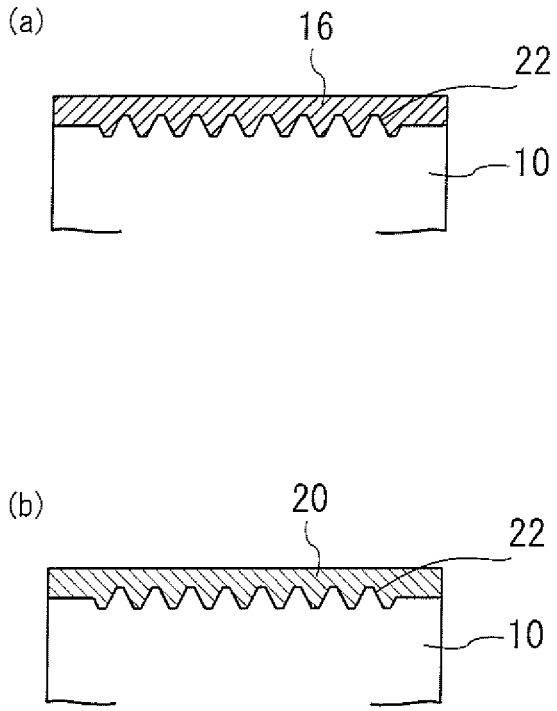
FIG. 3 is a sectional view of the surface layers in Embodiments (a) and (b) according to the present invention.

(a) and (b) in FIG. 3 show sectional views of the surface layer where, after the surface active treatment, the polished face 22 was formed on the surface of the metallic glass component 10 by physical polishing such as shotblast or barrel-rotation polishing, and subsequently, (a) the plating film 16 or (b) the metal deposition film 20 is formed. It is to be noted that the polishing method is not restricted to this, but buffing or sandblast may also be used.

Figure 4:
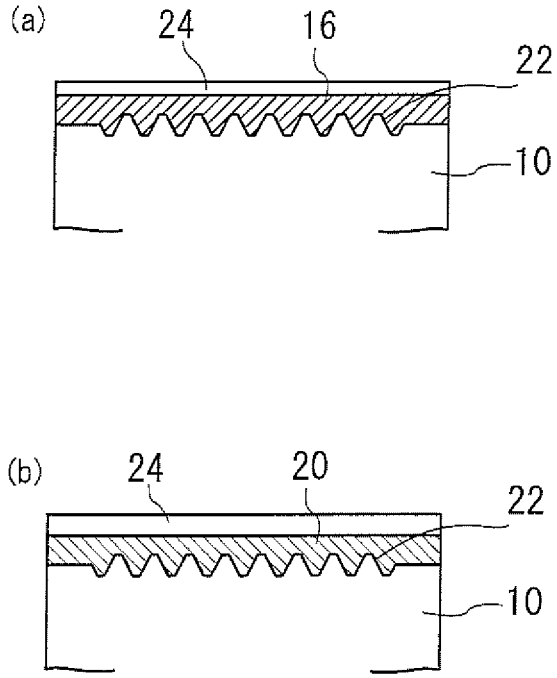
FIG. 4 is a sectional view of the surface layers in Embodiments (a) and (b) according to the present invention.

(a) and (b) in FIG. 4 show cross sectional views of the surface layer where, after the surface active treatment, the polished face 22 was formed on the surface of the metallic glass component 10 by physical polishing such as shotblast or barrel-rotation polishing, followed by formation of (a) the plating film 16 or (b) the metal deposition film 20 and spray coating with a transparent acrylic resin called "clear coat" on the film, to form the transparent resin coat 24.

The coating method is not restricted to spraying, but blushing, roller coating, immersion, printing or the like may be used. Further, nor only the entire surface may be uniformly coated as thus described, but also an arbitrary area may be coated. Although the transparent acrylic resin is typically used for the transparent resin coat 24, the material for the transparent resin coat 24 is not restricted thereto, but a solution having sufficient transparency and self-hardening properties may be applied.

Further, the thickness of the transparent resin coat 24 is preferably not smaller than 1 μm and not larger than 10 μm. The reason of the thickness is restricted is that bubbles are left in the coat when the solution is applied in the case of the thickness exceeding 10 μm, and hence transparency is reduced and enough flexibility to follow transformation of a component at the time of bending is not obtained, thereby leading to breaking of the film. On the other hand, when the thickness is below 1 μm, the surface of the metallic glass component 10 to locally become a substrate might be exposed at the time of coating by the coating method as described above, and the reliability is impaired.

Figure 5:
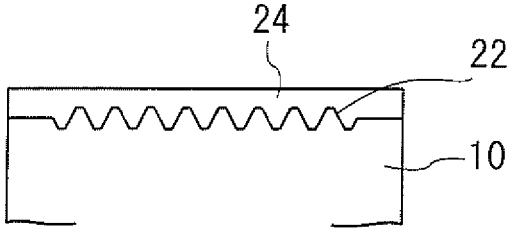
FIG. 5 is a sectional view of the surface layer in the embodiment according to the present invention.

FIG. 5 shows a sectional view of the surface layer where, after the surface active treatment, the polished face 22 is formed by physical polishing such as shotblast or barrel-rotation polishing, which provides metal gloss color and then spray-coated with a transparent acryl coat resin to form the transparent resin coat 24.

Figure 6:
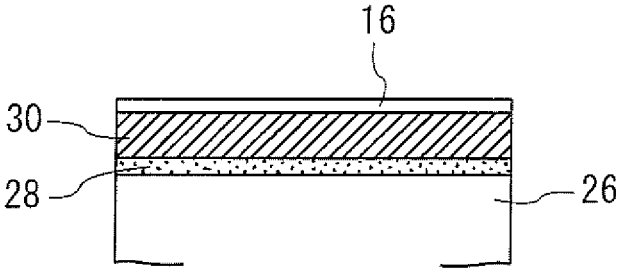
FIG. 6 is a sectional view of the surface layer in the embodiment according to the present invention.

FIG. 6 shows a sectional view of the surface layer where a primary Ni plating layer 28 is formed on a Zr—Cu—Al—Ni type metallic glass 26, and a Au plating layer 30 as a top layer, and the transparent acryl coating resin is spray-coated to the top surface to form the transparent resin coat 24. As thus described, plating may be constituted of two layers, primary and top plating, and in this case, the combination is not restricted to Ni and Au.

Examples

Table 1 shows evaluation results of surface layers in Examples 1 to 15 of the present invention, and Table 2 shows those in Comparative Examples 1 to 10.

Examples 1 to 15 are examples in which a surface layer was formed so as to be added with durability and a chromatic color according to the foregoing embodiment of the present invention, and Comparative Examples 1 to 10 are examples where a surface layer was formed out of the conditions for the embodiment of the present invention or by the conventional method.

Evaluations of the surface layers were obtained as a result that, after treatment of a specimen in size of 60 mm×45 mm as in the examples and the comparative examples, in addition to judgment as to (1) appearance uniformity by visual viewing, evaluation of (2) corrosion resistance (chemical resistance), (3) fingerprinting resistance (4) weathering resistance, and (5) peeling resistance of a coated film by an acceleration test were performed.

The corrosion resistance evaluation is an evaluation visually made as to whether the surface changed at the time of immersion into a 0.5% dilute nitric aqueous solution such that the surface was evaluated as "passed" when there was no change, and as "failed" when there was a change.

For the fingerprinting resistance evaluation, a test was conducted where fingerprints were put all over the surface of the specimen, the specimen was left in the atmosphere at constant temperature for 24 hours, and the fingerprints were then wiped out with a felt cloth. It was evaluated as "passed" when the fingerprints were completely wiped out, and as "failed" when a mineral or the like within the fingerprint even in a small amount was left.

For the weathering resistance evaluation, the specimen was subjected to an outside exposure test for 30 days, followed by washing with water, and whether or not there was a corrosion product or the like exists on the surface was visually determined. It was evaluated as "passed" when no corrosion product existed, and as "failed" when the product, even in a small amount was recognized.

For the film peeling resistance evaluation, an adhesive tape was placed all over the surface of the specimen, and at the time of peeling the tape, it was evaluated as "passed" when there was no damage on the surface layer film and as "failed" when damage was recognized. When visual judgment was difficult, the foregoing corrosion resistance evaluation was performed for judgment after peeling of the adhesive tape.

TABLE 1

| | Metallic Glass | Concentration in surface active treatment | Nitric acid/ Hydroflouric acid ratio | Temp. in surface active treatment | Time for surface active treatment | Surface polishing | Coating method | Coating metal |
|---|---|---|---|---|---|---|---|---|
| Example 1 | Zr base | 10% | 3:1 | 25° C. | 3 h | Barrel polishing | Vacuum deposition | Ti |
| Example 2 | Ti base | 9% | 2:1 | ↑ | 2 h | ↑ | ↑ | ↑ |
| Example 3 | Cu base | 10% | 3:1 | ↑ | 3 h | ↑ | ↑ | ↑ |
| Example 4 | Ni base | ↑ | ↑ | ↑ | ↑ | ↑ | ↑ | ↑ |
| Example 5 | Fe base | ↑ | ↑ | ↑ | ↑ | ↑ | ↑ | ↑ |
| Example 6 | Zr base | ↑ | ↑ | ↑ | ↑ | ↑ | Plating | 18K Gold |
| Example 7 | ↑ | ↑ | ↑ | ↑ | ↑ | ↑ | ↑ | 24K Gold |
| Example 8 | ↑ | ↑ | ↑ | ↑ | ↑ | No | ↑ | Pd |
| Example 9 | ↑ | ↑ | ↑ | ↑ | ↑ | ↑ | ↑ | Pt |
| Example 10 | ↑ | ↑ | ↑ | ↑ | ↑ | Yes | Vacuum deposition | Ti |
| Example 11 | ↑ | ↑ | ↑ | ↑ | ↑ | ↑ | ↑ | ↑ |
| Example 12 | ↑ | — | — | — | — | ↑ | — | — |
| Example 13 | ↑ | 1% | 2:1 | 12° C. | 24 h | ↑ | Vacuum deposition | Ti |
| Example 14 | ↑ | 10% | 3:1 | 40° C. | 5 min | ↑ | ↑ | ↑ |
| Example 15 | ↑ | 5% | 5:1 | 25° C. | 2 h | ↑ | ↑ | ↑ |

| | Transparent resin film | Thickness of resin film | Added color | 1 Appearance | 2 Corrosion resistance | 3 Fingerprint resistance | 4 Peeling resistance | 5 Weathering resistance |
|---|---|---|---|---|---|---|---|---|
| Example 1 | Yes | 2 μm | Blue | Passed | Passed | Passed | Passed | Passed |
| Example 2 | ↑ | ↑ | ↑ | ↑ | ↑ | ↑ | ↑ | ↑ |
| Example 3 | ↑ | ↑ | ↑ | ↑ | ↑ | ↑ | ↑ | ↑ |
| Example 4 | ↑ | ↑ | ↑ | ↑ | ↑ | ↑ | ↑ | ↑ |
| Example 5 | ↑ | ↑ | ↑ | ↑ | ↑ | ↑ | ↑ | ↑ |
| Example 6 | ↑ | ↑ | Pink | ↑ | ↑ | ↑ | ↑ | ↑ |
| Example 7 | ↑ | ↑ | Gold | ↑ | ↑ | ↑ | ↑ | ↑ |
| Example 8 | ↑ | ↑ | Silver | ↑ | ↑ | ↑ | ↑ | ↑ |
| Example 9 | ↑ | ↑ | Bright silver | ↑ | ↑ | ↑ | ↑ | ↑ |
| Example 10 | ↑ | 1 μm | Blue | ↑ | ↑ | ↑ | ↑ | ↑ |
| Example 11 | ↑ | 10 μm | ↑ | ↑ | ↑ | ↑ | ↑ | ↑ |
| Example 12 | ↑ | 2 μm | Gray | ↑ | ↑ | ↑ | ↑ | ↑ |
| Example 13 | ↑ | ↑ | Blue | ↑ | ↑ | ↑ | ↑ | ↑ |
| Example 14 | ↑ | ↑ | ↑ | ↑ | ↑ | ↑ | ↑ | ↑ |
| Example 15 | ↑ | ↑ | ↑ | ↑ | ↑ | ↑ | ↑ | ↑ |

TABLE 2

| | Metallic Glass | Concentration in surface active treatment | Nitric acid/ Hydroflouric acid ratio | Temp. in surface active treatment | Time for surface active treatment | Surface polishing | Coating method | Coating metal |
|---|---|---|---|---|---|---|---|---|
| Comparative Example 1 | Zr base | 10% | 3:1 | 25° C. | 3 h | Barrel polishing | Vacuum deposition | Ti |
| Comparative Example 2 | ↑ | ↑ | ↑ | ↑ | ↑ | ↑ | ↑ | ↑ |
| Comparative Example 3 | ↑ | ↑ | ↑ | ↑ | 3 min | ↑ | ↑ | ↑ |
| Comparative Example 4 | ↑ | ↑ | ↑ | 45° C. | 7 min | ↑ | ↑ | ↑ |
| Comparative Example 5 | ↑ | ↑ | 6:1 | 25° C. | 2 h | ↑ | ↑ | ↑ |
| Comparative Example 6 | ↑ | ↑ | 1:1 | ↑ | ↑ | ↑ | ↑ | ↑ |
| Comparative Example 7 | ↑ | 0.5% | 3:1 | ↑ | ↑ | ↑ | ↑ | ↑ |
| Comparative Example 8 | ↑ | 12% | ↑ | ↑ | ↑ | ↑ | ↑ | ↑ |
| Comparative Example 9 | ↑ | — | — | — | — | — | Atmosphere heating | — |
| Comparative Example 10 | ↑ | — | — | — | — | — | ↑ | — |

TABLE 2-continued

| | Transparent resin film | Thickness of resin film | Added color | 1 Appearance | 2 Corrosion resistance | 3 Fingerprint resistance | 4 Peeling resistance | 5 Weathering resistance |
|---|---|---|---|---|---|---|---|---|
| Comparative Example 1 | No | — | Blue | Passed | Failed | Failed | — | Failed |
| Comparative Example 2 | Yes | 0.1 μm | ↑ | ↑ | ↑ | ↑ | Failed | ↑ |
| Comparative Example 3 | ↑ | 2 μm | ↑ | ↑ | Passed | Passed | ↑ | Passed |
| Comparative Example 4 | ↑ | ↑ | ↑ | Failed | ↑ | ↑ | Passed | ↑ |
| Comparative Example 5 | ↑ | ↑ | ↑ | ↑ | Failed | Failed | Failed | Failed |
| Comparative Example 6 | ↑ | ↑ | ↑ | ↑ | ↑ | ↑ | ↑ | ↑ |
| Comparative Example 7 | ↑ | ↑ | ↑ | ↑ | ↑ | ↑ | ↑ | ↑ |
| Comparative Example 8 | ↑ | ↑ | ↑ | ↑ | ↑ | ↑ | ↑ | ↑ |
| Comparative Example 9 | No | — | Purple | ↑ | ↑ | ↑ | ↑ | ↑ |
| Comparative Example 10 | Yes | 2 μm | ↑ | ↑ | ↑ | ↑ | ↑ | ↑ |

It was confirmed as a result of the test that in all Examples, the surface layer which have corrosion resistance, weathering resistance and fingerprint resistance, a uniform chromatic color, and being resistant to peeling was formed.

Moreover, it was confirmed that in all Comparative examples, the surface layer was evaluated as "failed" in any of the evaluation items.

The invention claimed is:

1. A surface treatment method for a metallic glass component that is Zr based, Ti based, Cu based, Ni based or Fe based, comprising:

removing an oxide film on a surface of the metallic glass component and providing an anchor bond shape in an atomic level on the surface of the metallic glass component by surface active treatment with a mixed aqueous solution of nitric acid and hydrofluoric acid, prepared such that a volumetric ratio of the nitric acid to the hydrofluoric acid is in a range of 2 to 5 and a concentration of the mixed aqueous solution of nitric acid and hydrofluoric acid is 1 to 10% in a volumetric ratio; and forming a plating film on the surface of the metallic glass component by electroplating or electroless plating;

wherein, the surface active treatment is performed with the mixed aqueous solution at a temperature in the range of not lower than 10 degrees C. and not higher than 40 degrees C. in the reaction time in the range of five minutes to 24 hours.

2. The surface treatment method for a metallic glass component according to claim 1, further comprising:

adjusting a surface roughness by physical polishing between the surface active treatment and the electroplating, or the electroless plating.

3. The surface treatment method for a metallic glass component according to claim 2, further comprising:

forming a transparent resin coat by applying transparent resin after the electroplating or the electroless plating.

4. The surface treatment method for a metallic glass component according to 3, wherein, the transparent resin coat has a thickness in a range of not less than 1 μm and not more than 10 μm.

5. The surface treatment method for a metallic glass component according to claim 1, further comprising:

forming a transparent resin coat by applying transparent resin after the electroplating, or the electroless plating.

6. The surface treatment method for a metallic glass component according to claim 5, wherein, the transparent resin coat has a thickness in a range of not less than 1 μm and not more than 10 μm.

* * * * *

UNITED STATES PATENT AND TRADEMARK OFFICE

CERTIFICATE OF CORRECTION

PATENT NO. : 9,175,406 B2
APPLICATION NO. : 12/530920
DATED : November 3, 2015
INVENTOR(S) : Xin Min Wang et al.

It is certified that error appears in the above-identified patent and that said Letters Patent is hereby corrected as shown below:

Title Page Delete Item (73) and Insert

--(73) Assignee(s): TOHOKU UNIVERSITY, Miyagi (JP);
NGK INSULATORS, LTD., Aichi (JP)--

Signed and Sealed this
Third Day of May, 2016

Michelle K. Lee

Michelle K. Lee
*Director of the United States Patent and Trademark Office*